US006330932B1

(12) United States Patent
Reece

(10) Patent No.: US 6,330,932 B1
(45) Date of Patent: Dec. 18, 2001

(54) FRAME FOR RESCUE DEVICE

(76) Inventor: Norman Lee Reece, 940 Daphne, Broomfield, CO (US) 80020

( * ) Notice: Subject to any disclaimer, the term of this patent is extended or adjusted under 35 U.S.C. 154(b) by 0 days.

(21) Appl. No.: 09/769,696

(22) Filed: Jan. 25, 2001

(51) Int. Cl.[7] ..... A62B 1/20
(52) U.S. Cl. ..... 182/48; 182/70
(58) Field of Search ..... 182/48, 70

(56) References Cited

U.S. PATENT DOCUMENTS 4,367,809 * 1/1983 Eikelmann ..... 182/48
4,681,186 * 7/1987 Leisman ..... 187/48
5,320,195 * 6/1994 Reece et al. ..... 182/48
5,871,066 * 2/1999 Reece ..... 182/48

* cited by examiner

*Primary Examiner*—Alvin Chin-Shue
(74) *Attorney, Agent, or Firm*—H. Kenneth Johnston, II

(57) ABSTRACT

An improved rescue device for escape from buildings having more than a single story where the device is portable and may be deployed quickly in the event of an emergency. The rescue device has a lightweight frame for attaching to a structure and a single concentric chute. At a first end of the frame of the rescue device there is a vertical block having a hinged brace arm with a clamp bar and a second end with pressure blocks at the inner portion of said second end having an acute angle which allows the frame to straddle a window ledge where the clamp bar can be preset to the window wall width and when are locked into position by the use of a over-the-center lock secures the rescue device into place allowing the rescue device to be deployed.

2 Claims, 5 Drawing Sheets

FRAME FOR RESCUE DEVICE

BACKGROUND OF THE INVENTION

This invention relates to an improvement to a rescue device for the rapid deployment of the rescue device. Emergency situations require that rescue devices are able to be deployed quickly and safely. Fires and other emergency situations require immediate action to safely evacuate the building and minimize injury individuals trying to escape from the building. The problems respect to such disasters have been more serious in multi-story buildings as evacuation of them are much more difficult than that of a single-story structure. This invention is an improvement to the Rescue Device of Reece, U.S. Pat. No. 5,871,066 which provides for the safe and quick evacuation of individuals from a multi-story building. This invention has all of the advantages of the Reece Rescue Device and has improved on the ease of deployment allowing the within invention to be deployed much faster with substantially less change of an individual not being able to secure the rescue device securely to the structure. In U.S. Pat. No. 5,871,066, Reece discloses a system that requires the individual deploying the rescue device to wratchet the cinch strap securing the outside clamp arm against the building securing the rescue device in place. Although this provides a secure platform for deploying the rescue chute, it requires that an individual tighten the device in place. The within invention eliminates this requirement and utilizes an over the center lock mechanism securing the rescue device in place substantially faster and with considerably less effort on the part of the individual installing the device. The rescue device of the within invention is sized for the window opening so that when the device is required to be used for the evacuation of individuals in an emergency situation, it may be affixed to the structure window in a matter of a few seconds allowing the immediate evacuation of the individuals in an emergency situation. Although there are numerous rescue devices, if a person is unable to deploy the device it is of little use. Because the within device can be preset to the appropriate wall thickness in advance, the person having to use the rescue device does not have to make any additional adjustments and merely has to set the rescue device in the window sill and the inside bar is locked in place securing the rescue device immediately without further adjustments. When time is of the essence, the within rescue device saves precious seconds allowing for individuals to be evacuated much sooner than any other device.

The need to be able to deploy any rescue device quickly and with the least amount of effort on the part of the individual is required to provide the greatest amount of time for evacuation.

SUMMARY OF THE INVENTION

The present invention has met the need for allowing the least amount of time for the deployment of the rescue device. The rescue device of the present invention has a platform support frame which attaches to the window frame of a building utilizing outside pressure blocks and an inside pressure bar whereby the inside pressure bar is hinged to the frame and having an over the center clamp securing the rescue device in place. The rescue device can be deployed in less than 30 seconds.

In the preferred embodiment, the rescue device is quickly attached to a window frame and the chute is dropped allowing the endangered individual to descend to safety.

It is an object an of the present invention to provide an improved rescue device that will facilitate more efficient and safe egress of individuals from a building or other location during emergency situations.

It is further an object of the invention to provide such a rescue device that is economical to manufacture, durable and easy to use by those individuals unskilled in the use of such equipment.

These and other objects of the invention will be more fully understood from the following description of the invention on reference to the illustrations appended hereto.

DETAILED DESCRIPTION OF THE PREFERRED EMBODIMENT

Figure 1:
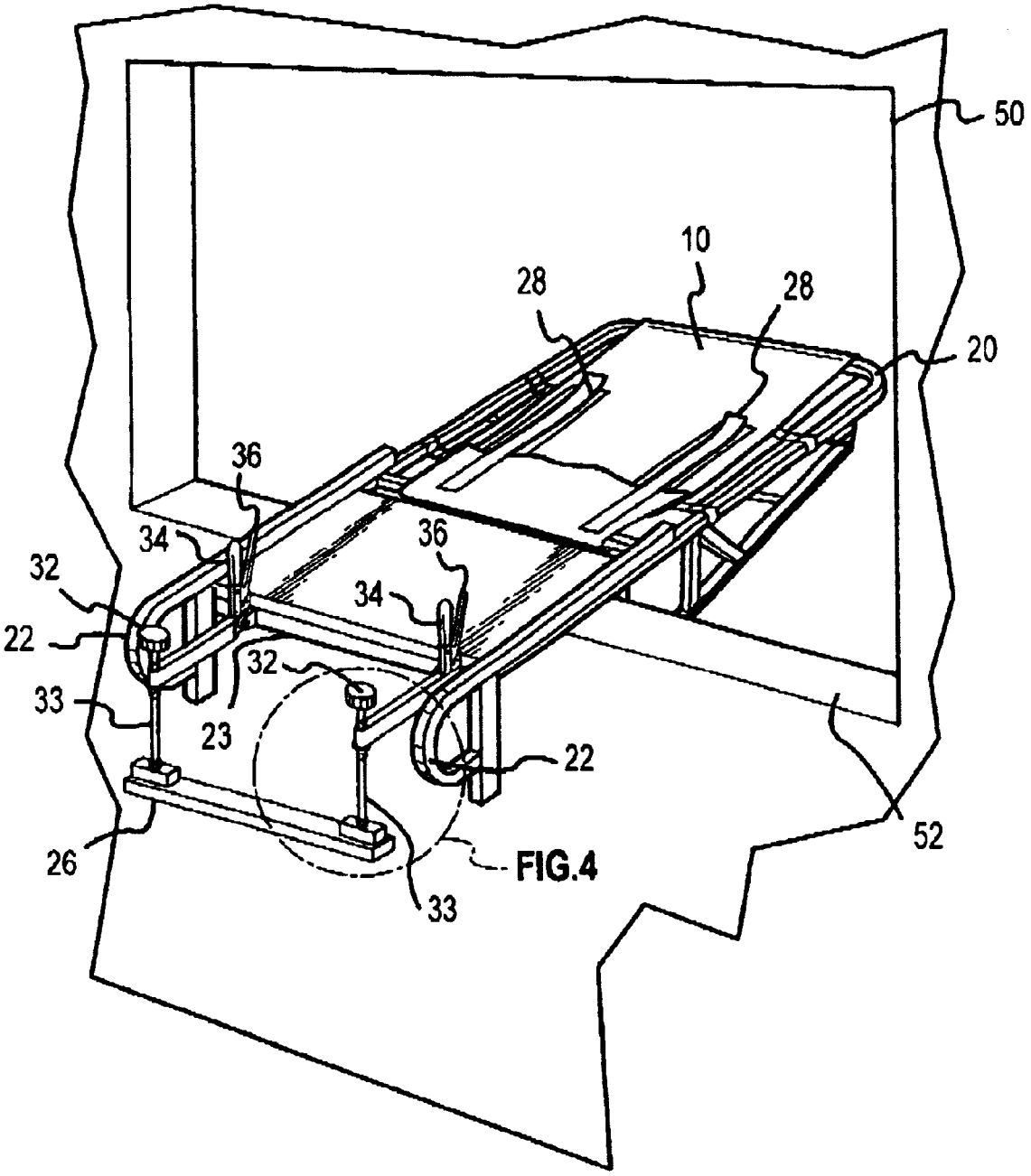
FIG. 1 is a perspective view of the rescue device partially installed.
Figure 2:
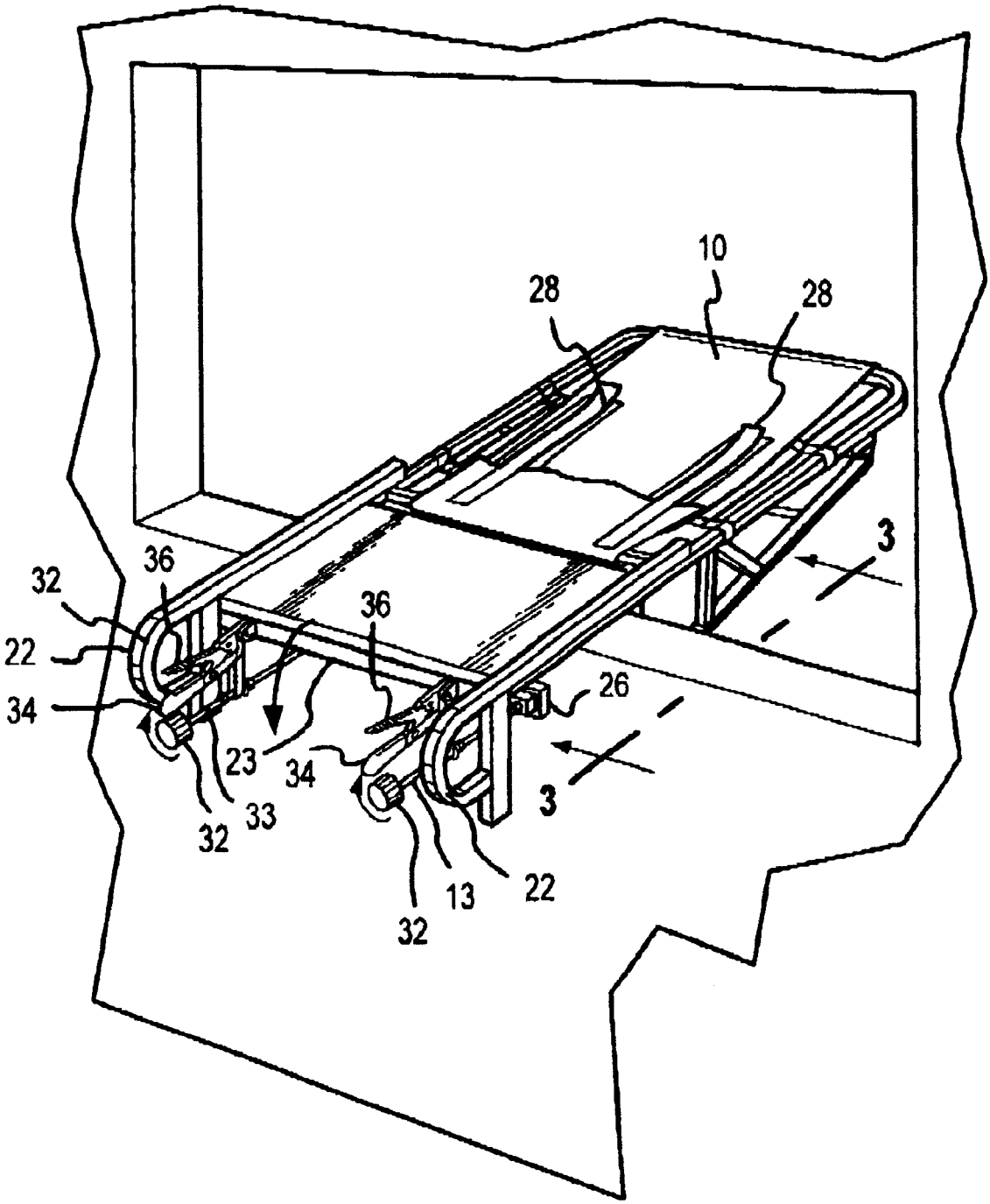
FIG. 2 is a perspective view of the rescue device in the installed mode.
Figure 3:
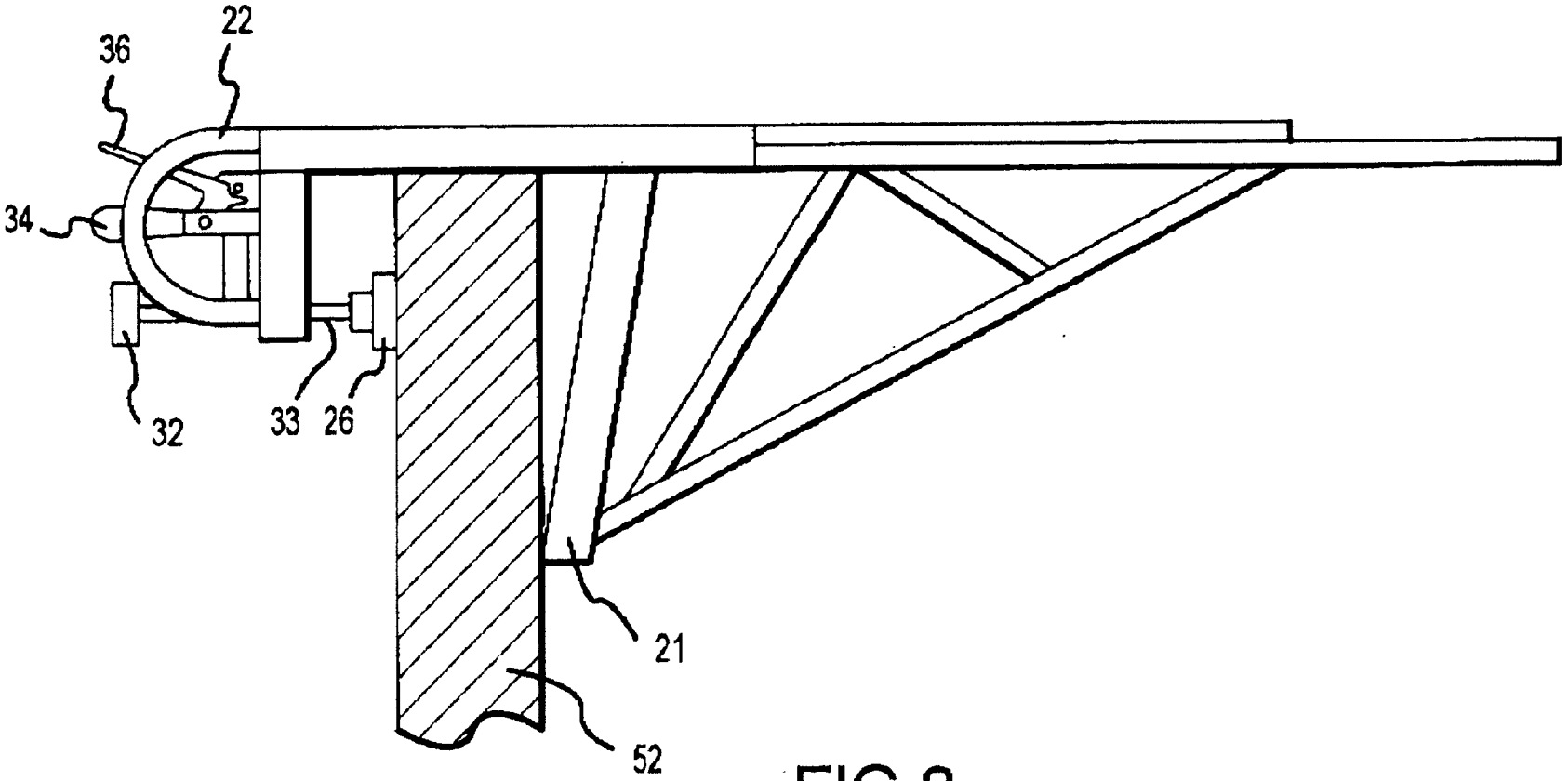
FIG. 3 is a cross-sectional view taken along the lines 3—3.

When needed the rescue device 10, which is made of a coated tubular aluminum, shown in FIG. 1, is removed from its emergency location and carried to a window by horizontal handles 22. If the rescue device is to be carried by one individual, the individual would carry the rescue device 10 by one of the horizontal handles 22 for ease of carrying. Once the rescue device 10 is brought to a window 50 it is placed over the window ledge 52 so that the rescue device rests on frame 20 between pressure block 21 and horizontal bar 23. The pressure block 21 and clamp bar 26 are large enough so that when frame 20 is resting on the window ledge 52 it will remain in place and even if frame 20 tilts downward pressure block 21 engages the exterior of the window and prohibits the rescue device 10 from falling off window ledge 52 as shown in FIG. 3. Although the clamp bar 26 and pressure block 21 will hold the rescue device in place while an individual is evacuated through the chute, (not shown), clamp bar 26 is secured against the inside of the window ledge 52 by lowering the over-center lock 36 into place as shown in FIG. 2 and FIG. 3.

Figure 4:
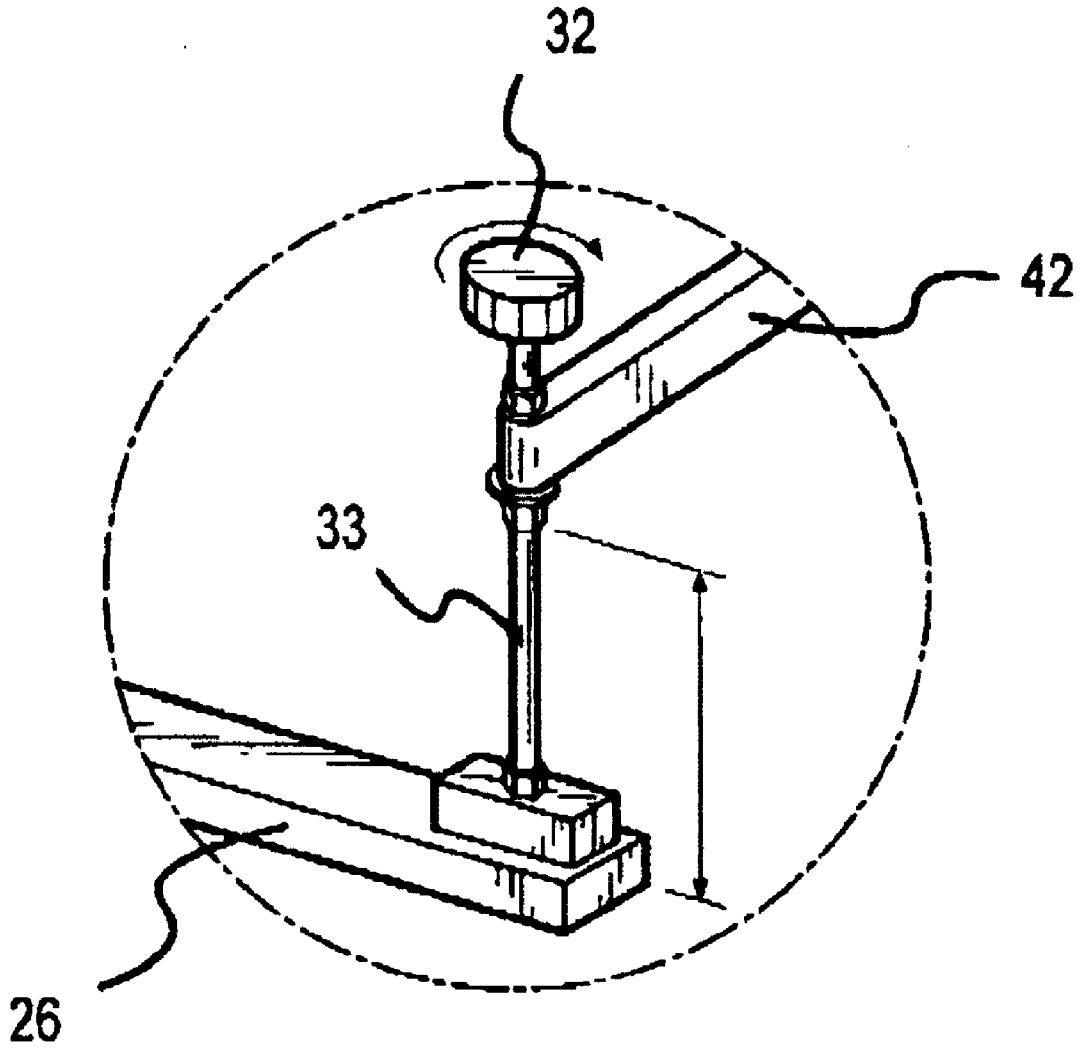
FIG. 4 is an enlargement of one of the adjustment members shown in FIG. 1.
Figure 5:
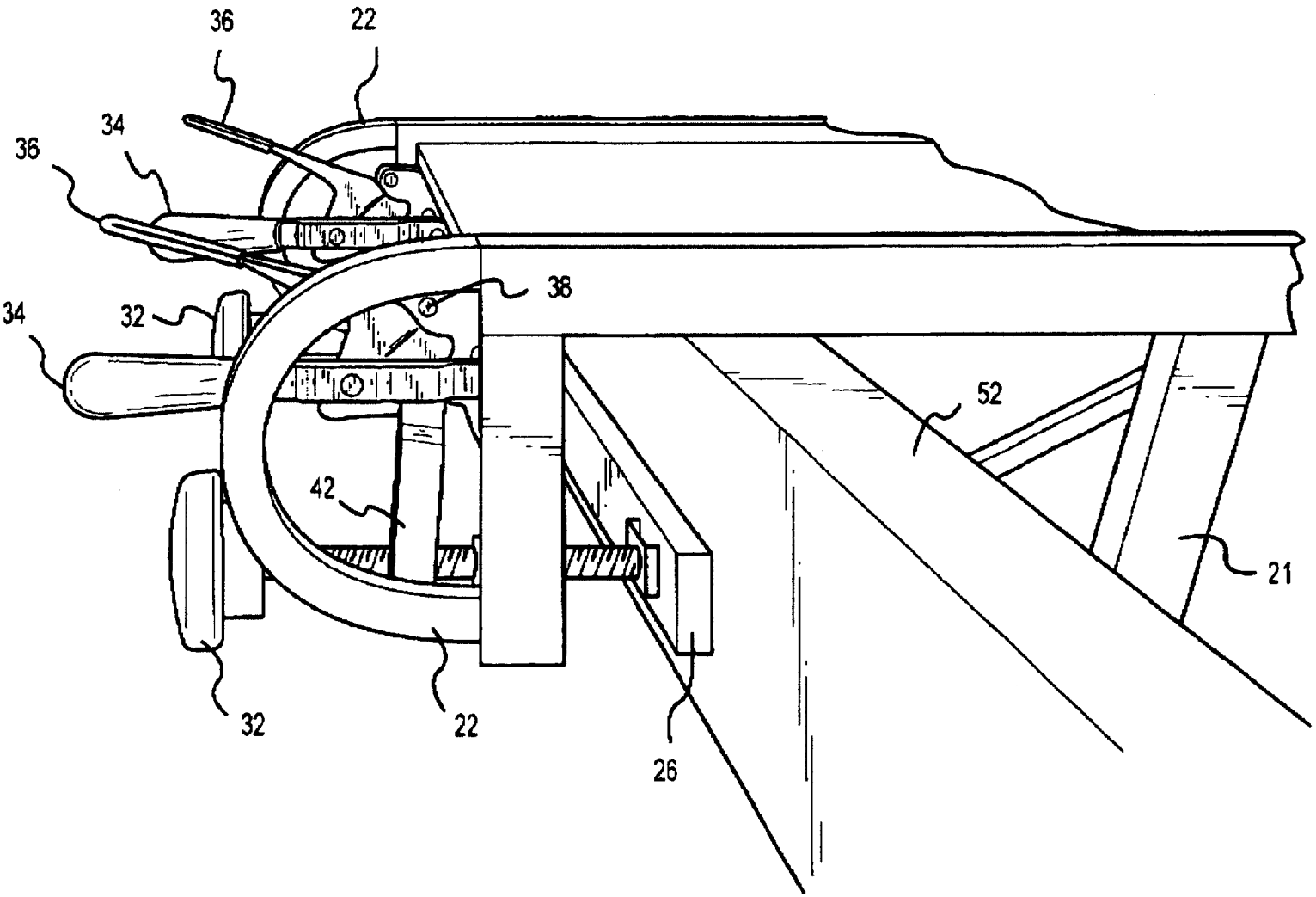
FIG. 5 is an enlargement of the adjustment members and locking device.

When the rescue device 10 is initially obtained, it can be adjusted for the window that it is intended to be used on. Therefore as shown in FIG. 1, when the rescue device is placed in window 50 on window ledge 52, brace arm 42 which is hingedly affixed to horizontal bar 23 is rotated so that the clamp bar 26 can be adjusted with the adjustment screws 33 by rotating the adjustment knobs 32 so that the adjustment screws 33 moves the clamp bar 26 toward the building as shown in FIG. 2 and FIG. 4. When the clamp bar 26 is adjusted to the appropriate distance, then the rescue device 10 is ready for use and when the rescue device 10 is placed on the window ledge 52, brace arm 42 is rotated and the clamp bar 26 is placed against the wall and the over-the-center locks 34 can be lowered in place locking the clamp bar 26 against the wall as shown in FIGS. 2, 3, and 5. The rescue device 10 has releasable push button safety locks 38 affixed to said brace arm which precludes the over-the-center locks 34 from releasing the clamp bar 26 fully even if the lock releases 36 are actuated and the clamp bar 26 is partially released. This prevents someone from inadvertently releasing the clamp bar 26 from the secure position. Although the clamp bar 26 secures the rescue device 10 securely against the window ledge 52, the pressure blocks 21 has an angle A of 80 degrees and about a foot in length such that the pressure blocks 21 rests against the outside wall and the horizontal bar 23 rests against the inside of the window ledge 52 precluding the rescue device 10 from dislodging from the window sill 52 as shown in FIG. 3. The pressure blocks 21 are at an angle greater than 79 degrees and less than 90 degrees as the length of pressure blocks 21 are dependent on angle A. If pressure blocks 21 are at an angle greater than the 80 degrees, then the pressure blocks 21 must be longer in length to compensate. The pressure blocks 21 angle is toward the structure forming an acute angle at angle A.

When the rescue device 10 is needed, it is carried by horizontal handles 22 and is placed on the window ledge 52, the brace arms 42 are rotated toward the window ledge 52 and the clamp bar 26 is placed against the inside wall and the over-the-center-lock 34 is lowered in place locking the rescue device 10 in place. An individual then climbs out on the frame 20 and deployment straps 28 are pulled releasing the escape chute (not shown) and allowing the individual to safely escape the area.

It is understood that there are certain variations in the invention that may be made without departing from the scope thereof. Whereas particular embodiments of the invention have been described above for the purpose of illustration, it will be appreciated by those skilled in the art that numerous variations of the details may be made without departing from the invention as described in the appended claims.

What is claimed:

1. An improved portable rescue device which is lighter in weight and faster and safer and faster to deploy consisting of:

a frame;

said frame having a first section and a second section;

said first section having a platform affixed thereon and said second section having an evacuation chute affixed thereto;

said first section of said frame having a horizontal bar with a plurality of brace arms hingedly affixed to said horizontal bar and said plurality of brace arms having a clamp bar adjustably affixed allowing said clamp bar to be temporarily affixed to an inside window ledge wall;

an over-the-center lock affixed to each said brace arm such that when said clamp bar is in place against said inside window ledge wall said over-the-center lock is actuated securing said clamp bar in place against said window ledge wall;

a second releasable safety lock affixed to at least one of said brace arms such that said over-the-center lock cannot be disengaged without releasing said safety lock preventing said over-the-center lock from accidentally being released;

said second section having a plurality of pressure blocks located at the inner portion of said second section;

said pressure blocks having an upper end and a lower end whereby said upper end is affixed to said frame and lower end is off the perpendicular toward the window ledge at an angle greater than 79 degrees and less than 90 degrees such that when said rescue device is placed on a window ledge said plurality of pressure blocks rest on the exterior of said window ledge and said clamp bar rest against the interior of said window ledge such that said rescue device is sufficiently secure to allow individuals to descend to safety during an emergency situation.

2. A rescue device of claim 1 wherein said angle of said plurality of pressure blocks are 80 degrees to the perpendicular.

* * * * *